US007556031B2

(12) United States Patent
Russell

(10) Patent No.: US 7,556,031 B2
(45) Date of Patent: Jul. 7, 2009

(54) DEVICE FOR ENHANCING FUEL EFFICIENCY OF AND/OR REDUCING EMISSIONS FROM INTERNAL COMBUSTION ENGINES

(75) Inventor: Raymond B. Russell, Clinton, TN (US)

(73) Assignee: Global Sustainability Technologies, LLC, Knoxville, TN (US)

( * ) Notice: Subject to any disclaimer, the term of this patent is extended or adjusted under 35 U.S.C. 154(b) by 36 days.

(21) Appl. No.: 12/022,726

(22) Filed: Jan. 30, 2008

(65) Prior Publication Data

US 2008/0178854 A1 Jul. 31, 2008

Related U.S. Application Data

(63) Continuation-in-part of application No. 11/520,372, filed on Sep. 13, 2006, now Pat. No. 7,412,974.

(60) Provisional application No. 60/749,576, filed on Dec. 12, 2005.

(51) Int. Cl.
*F02M 33/00* (2006.01)

(52) U.S. Cl. ..... 123/590; 123/306; 48/189.4

(58) Field of Classification Search ..... 123/306, 123/590; 48/189.4
See application file for complete search history.

(56) References Cited

U.S. PATENT DOCUMENTS 1,279,771 A * 9/1918 Snider ..... 48/189.6
1,602,390 A * 10/1926 Butler ..... 48/189.4
2,017,043 A * 10/1935 Galliot ..... 138/40
3,556,065 A 1/1971 Jordan
3,874,357 A 4/1975 List et al.
3,938,967 A * 2/1976 Reissmuller ..... 48/189.4
4,088,104 A * 5/1978 Ibbott ..... 48/189.4
4,159,881 A * 7/1979 Gogneau ..... 48/189.4
4,177,780 A * 12/1979 Pellerin ..... 123/590
4,180,041 A 12/1979 Miyazaki et al.
4,207,854 A 6/1980 Alford et al.
4,295,458 A 10/1981 Pellerin
4,307,697 A 12/1981 Ong
4,308,832 A 1/1982 Okumura et al.
4,318,386 A 3/1982 Showalter et al.
4,333,441 A 6/1982 Still et al.
4,336,776 A 6/1982 Sumiyoshi et al.
4,366,787 A 1/1983 Gale
4,409,951 A 10/1983 Whitworth (Continued)

OTHER PUBLICATIONS

Battistoni et al.; SAE Technical Paper Series 2008-01-2392, "Steady and Transient Fluid Dynamic Analysis of the Tumble and Swirl Evolution on a 4V Engine with Independent Intake Valves Actuation"; Rosemont, Illinois, Oct. 6-9, 2008.

(Continued)

*Primary Examiner*—Erick Solis
(74) *Attorney, Agent, or Firm*—DLA Piper LLP US

(57) ABSTRACT

An air/fuel flow structure for enhancing the fuel efficiency of an internal combustion engine includes a generally conical-shaped flow path useable in the engine. One or more tab and one or more notch are formed in the conical path to alter one or more characteristics, such as pressure and velocity, of the gas flow. The apparatus may be positioned in the air intake system. Alternatively, the apparatus may be positioned in the exhaust system.

20 Claims, 18 Drawing Sheets

U.S. PATENT DOCUMENTS

| | | | | |
|---|---|---|---|---|
| 4,872,440 | A * | 10/1989 | Green | 123/590 |
| 4,903,993 | A | 2/1990 | Brammer | |
| 5,097,814 | A | 3/1992 | Smith | |
| 5,301,939 | A | 4/1994 | Ellsworth | |
| 5,392,752 | A * | 2/1995 | Brogan et al. | 123/591 |
| 5,435,283 | A | 7/1995 | Zehr | |
| 5,579,645 | A | 12/1996 | Prociw et al. | |
| 5,884,598 | A | 3/1999 | Kawashima | |
| 5,908,475 | A * | 6/1999 | Morris et al. | 48/189.3 |
| 5,979,395 | A | 11/1999 | Mallen et al. | |
| 6,055,727 | A | 5/2000 | Brignall et al. | |
| 6,280,317 | B1 | 8/2001 | Przilas et al. | |
| 6,449,947 | B1 | 9/2002 | Liu et al. | |
| 6,550,446 | B1 | 4/2003 | Robley, Jr. | |
| 6,604,850 | B1 | 8/2003 | Schneider et al. | |
| 6,796,296 | B2 | 9/2004 | Kim | |
| 6,837,213 | B1 | 1/2005 | Burnett | |
| 7,210,448 | B2 | 5/2007 | Stanton et al. | |
| 2003/0226539 | A1 | 12/2003 | Kim | |
| 2004/0221830 | A1 | 11/2004 | Kuehner et al. | |
| 2005/0035219 | A1 | 2/2005 | Rock | |
| 2005/0188969 | A1 | 9/2005 | Wheeler, III | |
| 2006/0096573 | A1 | 5/2006 | Jonson | |
| 2007/0131198 | A1 | 6/2007 | Russell | |
| 2007/0266989 | A1 * | 11/2007 | Yang | 123/306 |

OTHER PUBLICATIONS

Wilson et al.; SAE Technical Paper Series 930821, "Asymmetric Valve Strategies and Their Effect on Combustion"; Detroit, Michigan, Mar. 1-5, 1993.

Bergin et al.; SAE Technical Paper Series 2007-01-0912, "Fuel Injection and Mean Swirl Effects on Combustion and Soot Formation in Heavy Duty Diesel Engines"; Detroit, Michigan, Apr. 16-19, 2007.

Arora et al.; "Effect of Swirl on the intake of Turbocharger"; SAE International 2008.

He et al.; SAE Technical Paper Series 2007-01-3992, "Effect of Intake Primary Runner Blockages on Combustion Characteristics and Emissions with Stoichiometric and EGR-Diluted Mixtures in SI Engines"; Rosemont, Illinois, Oct. 29-Nov. 1, 2007.

Shi et al.; SAE Technical Paper Series 2008-01-0949; "Assessment of Optimization Methodologies to Study the Effects of Bowl Geometry, Spray Targeting and Swirl Ratio for a Heavy-Duty Diesel Engine Operated at High-Load"; Detroit, Michigan; Apr. 14-17, 2008.

Blechstein et al.; SAE Technical Paper Series 2007-01-0640; "Effects of Charge Motion Characteristics on Engine Variables such as Emission Behavior and Efficiency"; Detroit, Michigan, Apr. 16-19, 2007.

Reese et al.; SAE Technical Paper Series 2007-01-4003; "Impact of Tumble on Combustion in SI Engines: Correlation between Flow and Engine Experiments"; Rosemont, Illinois; Oct. 29-Nov. 1, 2007.

Office Action issued in copending related U.S. Appl. No. 11/520,372, mailed Aug. 22, 2007.

International Search Report issued in related International Application No. PCT/US08/85631, mailed Feb. 3, 2009.

Written Opinion Issued in related International Application No. PCT/US08/85631, mailed Feb. 3, 2009.

International Search Report issued in related foreign International Application No. PCT/US06/46989, mailed Oct. 18, 2007.

* cited by examiner

DEVICE FOR ENHANCING FUEL EFFICIENCY OF AND/OR REDUCING EMISSIONS FROM INTERNAL COMBUSTION ENGINES

REFERENCE TO RELATED APPLICATIONS

This is a continuation-in-part of U.S. application Ser. No. 11/520,372, filed Sep. 13, 2006, which in turn claims priority to U.S. Provisional Patent Application No. 60/749,576, filed Dec. 12, 2005, the disclosures of both of which are incorporated herein by reference.

FIELD OF THE INVENTION

The present invention relates to a device for enhancing the fuel efficiency of internal combustion engines.

BACKGROUND OF THE INVENTION

The fuel efficiency of an internal combustion (IC) engine depends on many factors. One of these factors is the extent to which the fuel is mixed with air prior to combustion. Another factor that affects fuel efficiency is the amount of air that can be moved through the engine. Backpressure in the exhaust system restricts the amount of air that can be input to the engine. Additionally, most IC engines of the spark ignition type employ a so-called "butterfly" valve for throttling air into the engine. But the valve itself acts as an obstruction to air flow even when fully open.

A variety of devices has been proposed that attempt to provide better fuel-air mixing by imparting turbulence to the intake air. For example, one class of devices utilizes serpentine geometries to impart swirl to the intake air on the theory that the swirling air will produce a more complete mixing with the fuel. Other devices utilize fins or vanes that deflect the air to produce a swirling effect.

For example, U.S. Pat. No. 2,017,043 to Galliot describes a helical groove formed along an interior wall of a pipe, much like the spiral groove formed inside a gun barrel, purportedly to prevent the formation of whirlpools or eddies in the flow of the fluid in the pipe. According to Galliot, by preventing the whirlpools and eddies, the flow of fluid in the pipe can better conform to the interior contour of the pipe. Galliot, however, is not concerned at all of mixing two different types of gaseous and/or liquid material together.

U.S. Pat. No. 4,177,780 to Pellerin discloses a "frusto-conical" element having a perforated wall mounted between the carburetor and the intake manifold of an internal combustion engine to force the fuel droplets in the air/fuel mixture to impact the perforated wall and break up to produce an aerosol, but requires a specific structure, e.g., a "turn," within the conical element to force the liquid particles of the fuel to impact the perforated wall at a high speed.

U.S. Pat. No. 4,872,440 to Green discloses an air fuel mixing device including a double ring structure, each of which rings having openings to receive air, and the outer ring of which is allowed to rotate with respect to the inner ring, thereby varying the net opening size resulting from the aligning of the respective openings of the rings, to purportedly adjust the air/fuel ratio of the mixture. Green however does not disclose any structure to promote better mixing of the resulting mixture.

U.S. Pat. No. 3,938,967 to Reissmuller discloses a number of helically twisted fin like structures and blades mounted within the throat of an intake manifold of an internal combustion engine, purportedly to produce gyrating air/fuel mixture flow. According to Reissmuller, the gyrating flow of the mixture and non-gyrating flow, resulting from passing straight through a nozzle away from the fins and blades, together produce a turbulence that promotes better mixing. Reissmuller however requires a complex fins and blades, which are difficult to fabricate.

U.S. Pat. No. 5,097,814 to Smith discloses a "tuned air insert" device having a generally tubular shape, which may include surface irregularities. i.e., a rib or flute structure on the internal wall thereof, to "tune" a two cycle engine, i.e., those typically used in gas powered hand tools and model airplanes, at an optimal RPM by adjusting the placement of the device within the air duct leading to the inlet of the carburetor. According to Smith, the placement of the device creates a "venturi effect" in the air within the chamber formed between the device and the inlet opening of the carburetor. By adjusting the size of the chamber, achieved through the adjustment in the placement of the insert device, the two cycle engine is to be tuned for optimal fuel efficiency. However, the tuned air insert device of Smith does not include the features of the present invention that are found to be most beneficial in enhancing fuel efficiency.

Unfortunately, these devices provide less than satisfactory results. What is needed, therefore, is a device that can be easily constructed and is installed into new, as well as existing, IC engines to effectively increase fuel efficiency.

BRIEF SUMMARY OF THE INVENTION

Accordingly, it is an aspect of the present invention to provide a device that can be placed in the air and/or fuel flow path to enhance mixing of the air and fuel, to provide better fuel efficiency of an internal combustion engine, and/or an engine utilizing such device.

Additional aspects of the present invention will be set forth in part in the description which follows and, in part, will be obvious from the description, or may be learned by practice of the present invention.

The foregoing and/or other aspects of the present invention can be achieved by providing a fuel efficiency enhancing structure for use in an internal combustion engine having an air intake system and an exhaust system. The structure includes a generally conical-shaped flow path having an inlet through which at least one of air and fuel enters into the generally conical-shaped flow path and an outlet through which the at least one of air and fuel exits from the generally conical-shaped flow path. An inner volume of the generally conical-shaped flow path is defined by a wall interconnecting the inlet and the outlet. The outlet has an outlet circumference smaller than an inlet circumference of the inlet. At least one tab is disposed on the wall, and protrudes from the wall into the inner volume of the conical shaped flow path. At least one notch is formed on the wall and has an opening at the outlet of the generally conical-shaped flow path and a closed end defined by the wall at a location along the wall between the inlet and the outlet.

According to another aspect of the present invention, a fuel efficiency enhancing structure for use in an internal combustion engine comprises a generally conical-shaped flow path having an inlet through which at least one of air and fuel enters into the generally conical-shaped flow path and an outlet through which the at least one of air and fuel exits from the generally conical-shaped flow path. An inner volume of the generally conical-shaped flow path being defined by a wall interconnecting the inlet and the outlet. The outlet having an outlet circumference smaller than an inlet circumference of the inlet. The structure also includes at least one first deformation located along the wall of the generally conical-shaped flow path. The at least one first deformation interferes with a flow of the at least one of air and fuel to impart a tumbling movement to the flow. The tumbling movement is a rotational movement about a first rotational axis substantially perpendicular to a central axis. The central axis is an axis extending through respective centers of the inlet and the outlet. The structure further includes at least one second deformation located along the wall of the generally conical-shaped flow path. The at least one second deformation imparts a swirling movement to the flow of the at least one of air and fuel. The swirling movement is a rotational movement about a second rotational axis substantially parallel to the central axis.

BRIEF DESCRIPTION OF THE DRAWINGS

Several embodiments of the invention will now be described in further detail. Other features, aspects, and advantages of the present invention will become better understood with regard to the following detailed description, appended claims, and accompanying drawings (which are not to scale) where:

DETAILED DESCRIPTION OF SEVERAL EMBODIMENTS

Figure 1:
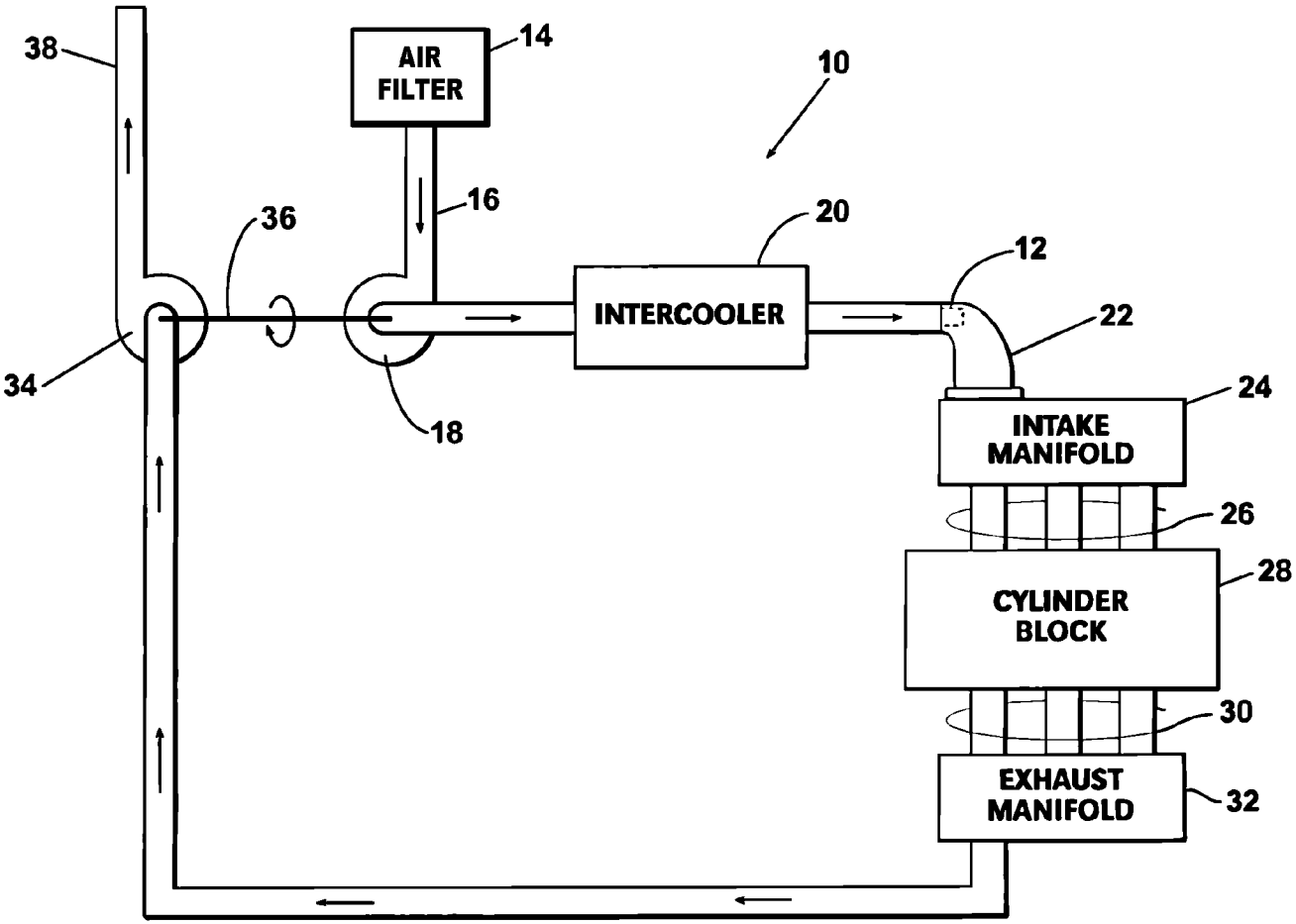
FIG. 1 is a functional block diagram showing a fuel efficiency enhancement device installed in a diesel engine according to an embodiment of the invention.

Turning now to the drawings wherein like reference characters indicate like or similar parts throughout, FIG. 1 illustrates a typical turbo-charged diesel engine 10 having installed therein a fuel efficiency enhancement device, or gas flow conditioner 12, for enhancing the flow of gas in an IC engine having an air intake system and an exhaust system. The conditioner is sized to fit inside a duct or other passageway for intake air, a fuel-air mixture, or exhaust. Although FIG. 1 illustrates a particular type of IC engine (i.e., a turbo-charged diesel engine), it will be understood that the invention may be employed in other engine types, including spark ignition engines with or without turbo charging, with or without fuel injection, etc. Additionally, while FIG. 1 shows a particular placement of the gas flow conditioner 12, it will be understood that the conditioner 12 can be advantageously positioned at other areas of the engine, as further explained below.

Intake air for the engine 10 passes through an air filter 14 and is conducted through air passage 16 to a turbocharger compressor 18 where the air is compressed. Compressed air exiting turbocharger 18 is passed through an air-to-air intercooler 20 before entering snorkel 22. For the particular application shown in FIG. 1, the cooled air enters snorkel 22 through conditioner 12, which is configured to accelerate, and to impart turbulence in, the air for better fuel mixing and throughput. Air exiting snorkel 22 is received by intake manifold 24, which distributes the air through intake passages 26 to the engine cylinder block 28 where the air is mixed with fuel and combusted. Exhaust exits cylinder block 28 through exhaust passages 30 and enters exhaust manifold 32. The exhaust is conducted to a turbocharger turbine 34, which turns shaft 36 to drive compressor 18. After exiting turbine 34, the exhaust is vented to atmosphere through exhaust stack 38.

Testing of the conditioner 12 has shown that it can be configured in a variety of ways to enhance the fuel efficiency of the engine 10, thereby enabling the engine 10 to operate with increased power and mileage and reduced engine emissions. In one embodiment of the conditioner 12 shown in FIG. 2, the conditioner 12 is generally conical-shaped with a central axis 40. The conditioner 12 includes an inlet 42 for receiving at least a portion of a flow of gas within the engine 10 (i.e., inlet air, air-fuel mixture, exhaust). An outlet 44 in opposed relation to the inlet 42 outputs at least a portion of the gas received by the inlet 42. Being of generally conical shape, the circumference of the outlet 44 is smaller than the circumference of the inlet 42. A wall 46 interconnects the inlet and outlet. The taper angle $\alpha$ of wall 46 is preferably in the range of about 10 degrees to about 20 degrees.

In all embodiments described herein, the wall 46 includes one or more deformations for altering one or more characteristics (such as velocity, direction, and pressure) of the flow of gas. For the embodiment of FIG. 2, such deformations are in the form of a plurality of circumferentially spaced notches 48*a-c* formed in the wall 46 adjacent the outlet 44. Preferably, notches 48*a-c* are symmetrically spaced. Notches 48*a-c* are believed to enhance operation of the conditioner 12 by imparting turbulence to the flow of gas as will be further described later.

Figure 3:
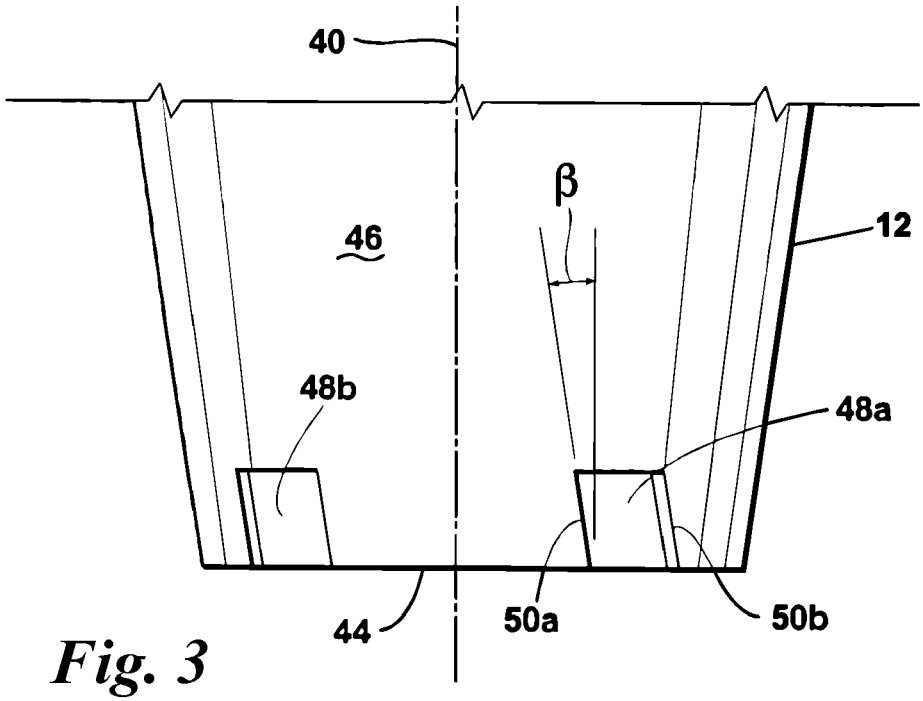
FIG. 3 is a sectional view of the fuel efficiency enhancement device of FIG. 2.

With reference to FIG. 3, each notch 48*a-c* (for clarity, only notches 48*a* and 48*b* are shown in FIG. 3) preferably includes two edges 50*a-b* extending from the outlet 44 toward the inlet 42. Also preferably, the opposed edges 50*a-b* of each notch 48*a-c* are substantially parallel and offset relative to the central axis 40 of the conditioner 12 by an angle $\beta$. Edges 50*a-b* can be offset in either a clockwise direction (as shown in FIG. 3) or a counterclockwise direction. Offset angle $\beta$ is preferably about 30 degrees, but may be anywhere within the range of about 25 degrees to about 40 degrees. Alternatively, edges 50*a-b* of each notch 48*a-c* are parallel with central axis 40. In addition, each of the notches 48*a-c* may be offset at a different offset angle $\beta$ than that of the other ones of the notches 48*a-c*.

With reference back to FIG. 2, it can be seen that notch 48*c* is angled in a direction opposite to that of notches 48*a* and 48*b*. Testing has shown that reversing one of the notches in this manner further enhances fuel efficiency. However, all of the notches 48*a-c* may be angled in the same direction with beneficial result to fuel efficiency.

Figure 4:
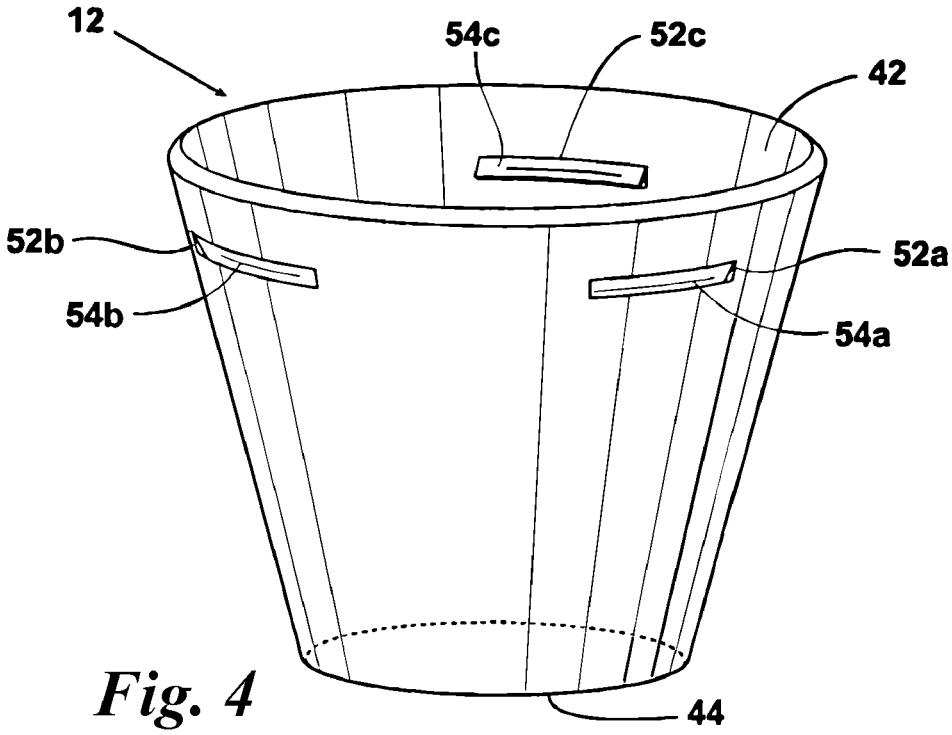
FIG. 4 is a front elevational view of another example of a fuel efficiency enhancement device.

In another embodiment of the conditioner 12 shown in FIG. 4, deformations of wall 46 are in the form of a plurality of circumferentially spaced tabs 52*a-c* formed in the wall 46 intermediate the inlet 42 and the outlet 44. Preferably, tabs 52*a-c* are symmetrically spaced. Each of the tabs 52*a-c* includes a ramp 54*a-c* extending from the wall 46 into the conditioner 12. Ramps 54*a-c* function to deflect a portion of the gas flowing adjacent the inner surface of the wall 46 and are believed to enhance operation of the conditioner 12 by imparting turbulence to the flow of gas as will be further described later.

Figure 5:
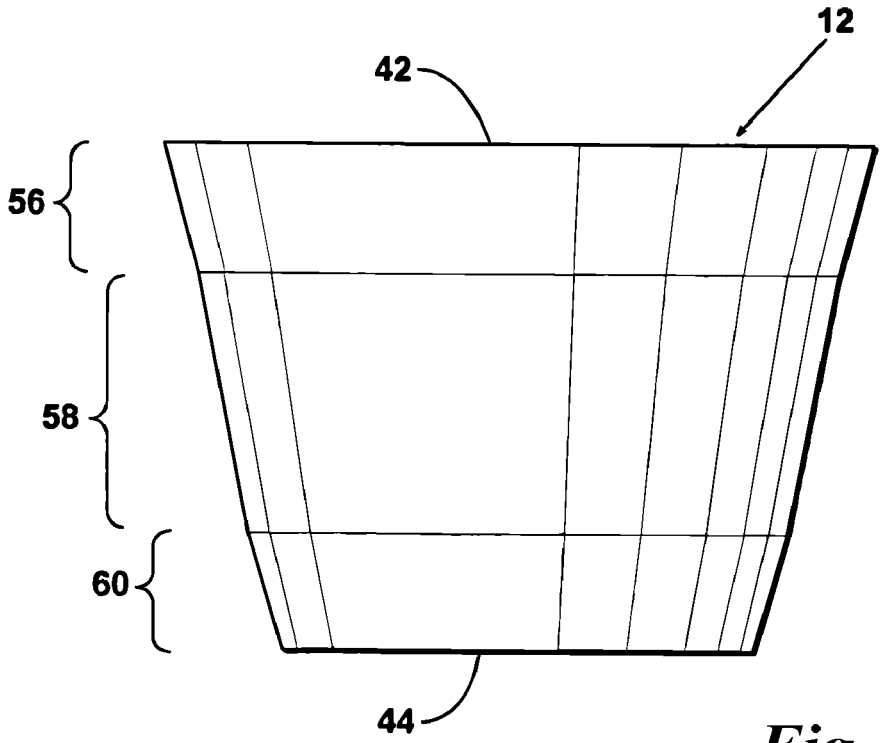
FIG. 5 is a side view of yet another example of a fuel efficiency enhancement device.

In yet another embodiment of the conditioner 12 shown in FIG. 5, deformations of wall 46 are in the form of a plurality of taper angles $\alpha$ from the inlet 42 to the outlet 44. FIG. 5 illustrates a conditioner 12 with three varying angles of taper, including a first taper angle along wall portion 56, a second taper angle along wall portion 58, and a third taper angle along wall portion 60. Preferably, the taper angle along wall portion 56 is about 15 degrees, the taper angle along wall portion 58 is about 11 degrees, and the taper angle along wall portion 60 is about 16 degrees.

Figure 6:
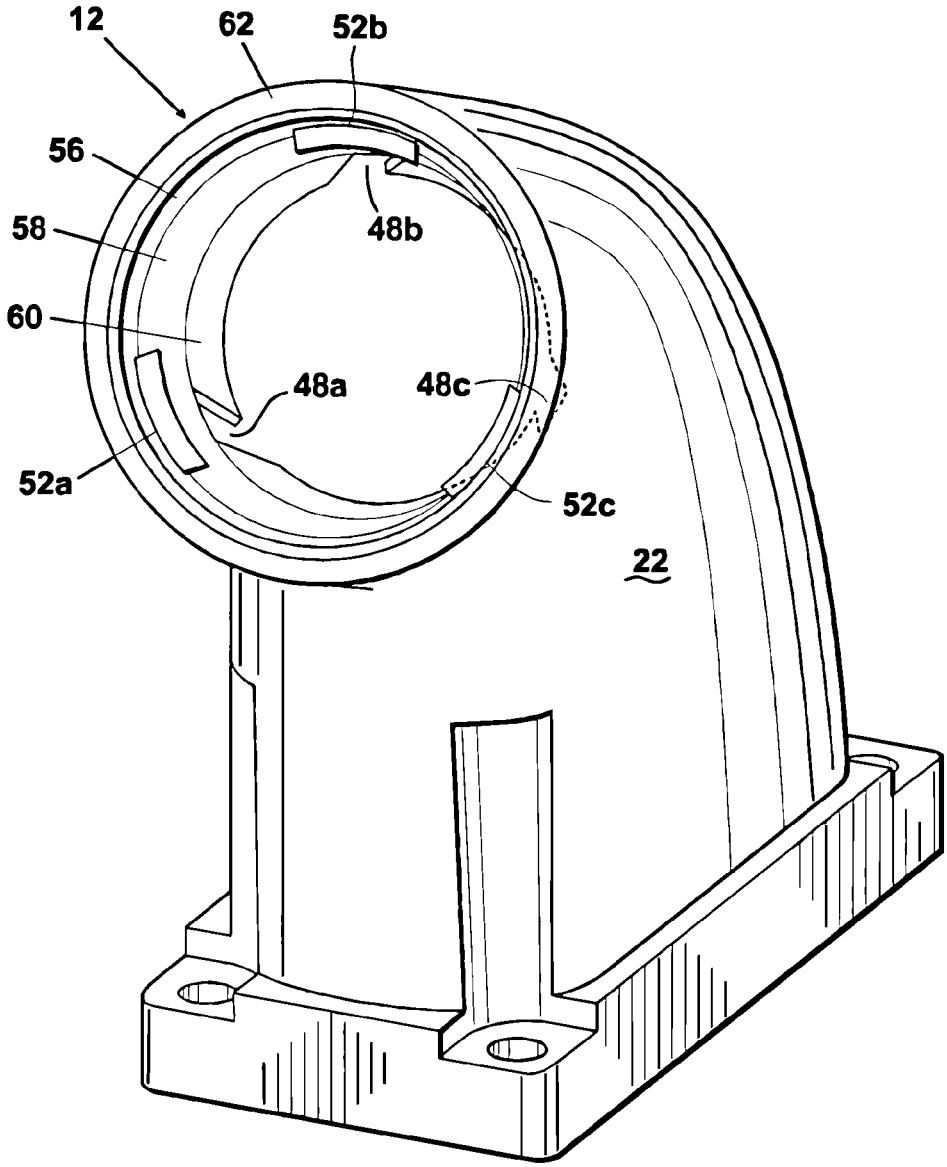
FIG. 6 is perspective view of a fuel efficiency enhancement device installed in the snorkel of a diesel engine according to an embodiment of the invention.

One or more of the above-described wall deformation types may be incorporated into the conditioner 12 to beneficially alter one or more characteristics (velocity, direction, pressure) of the flow of gas. For example, FIG. 6 shows a conditioner 12 with tabs 52*a-c*, notches 48*a-c*, and varying taper zone portions 56, 58, 60 installed at the inlet of snorkel 22 (FIG. 1). A flange 62 is provided at the inlet 42 of the conditioner 12 to facilitate installation. Testing has shown that, for the particular conditioner 12 shown in FIG. 6, optimal performance of the conditioner 12 is obtained by aligning each of the tabs 52*a-c* with one of the notches 48*a-c* as shown.

Figure 7:
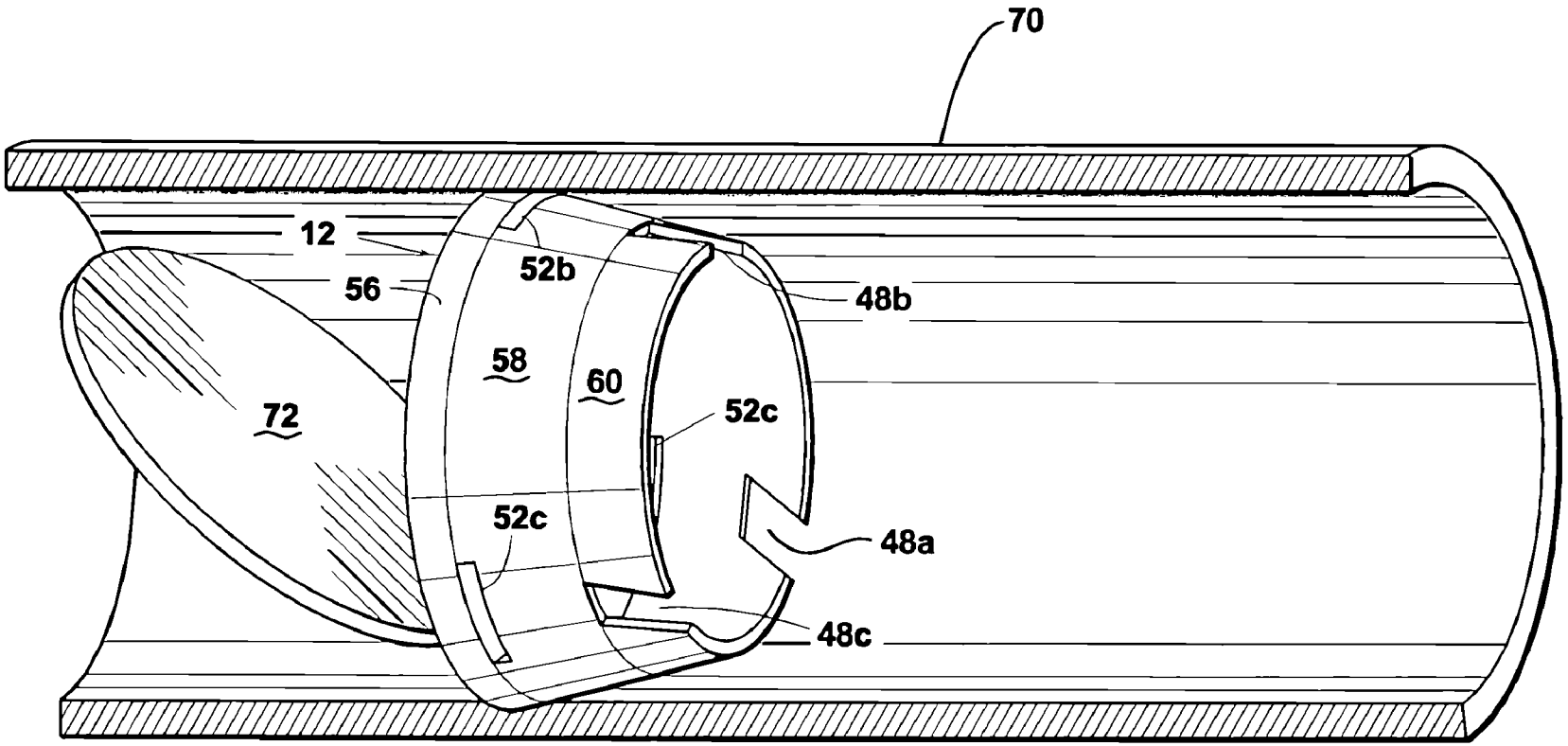
FIG. 7 is a sectional view of a pipe representing an air inlet for a spark ignition engine containing a butterfly throttle valve and a fuel efficiency enhancement device according to another embodiment of the invention.
Figure 8A:
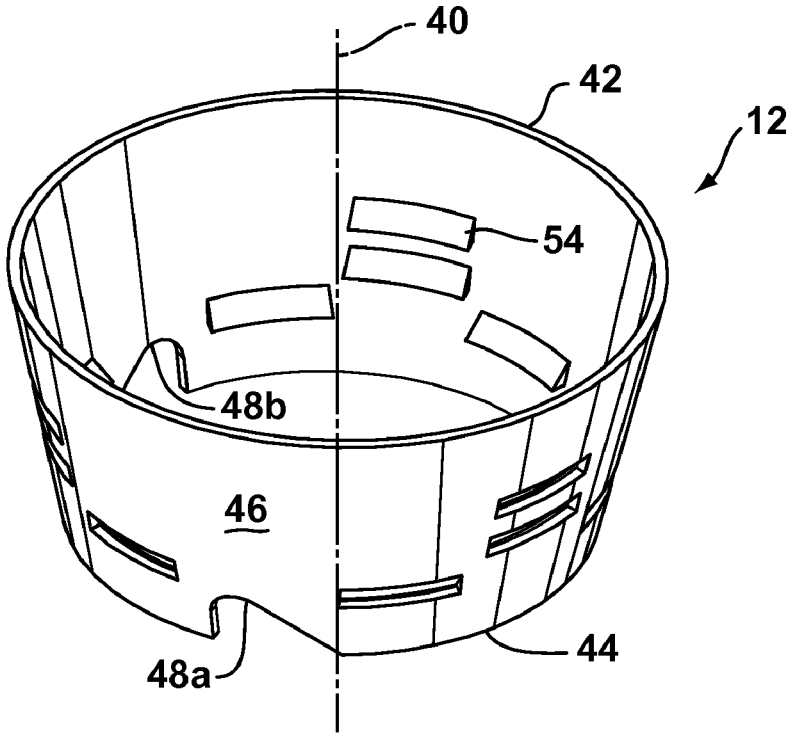
FIG. 8A is a top perspective view of yet another example of a fuel efficiency enhancement device.
Figure 8B:
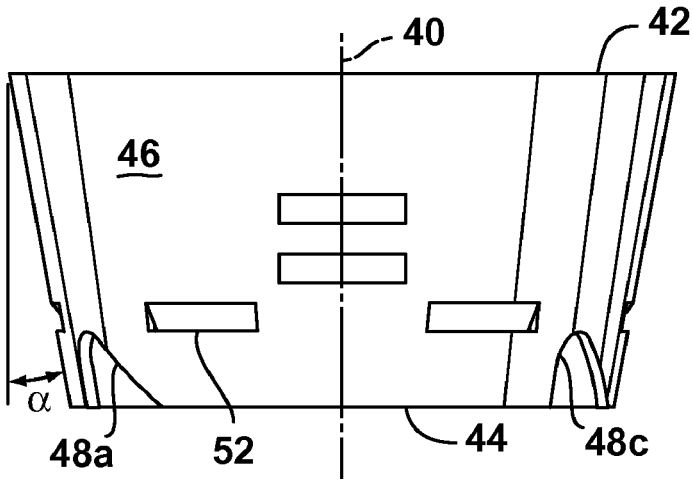
FIG. 8B is a side view of the example of a fuel efficiency enhancement device shown in FIG. 8A.
Figure 8C:
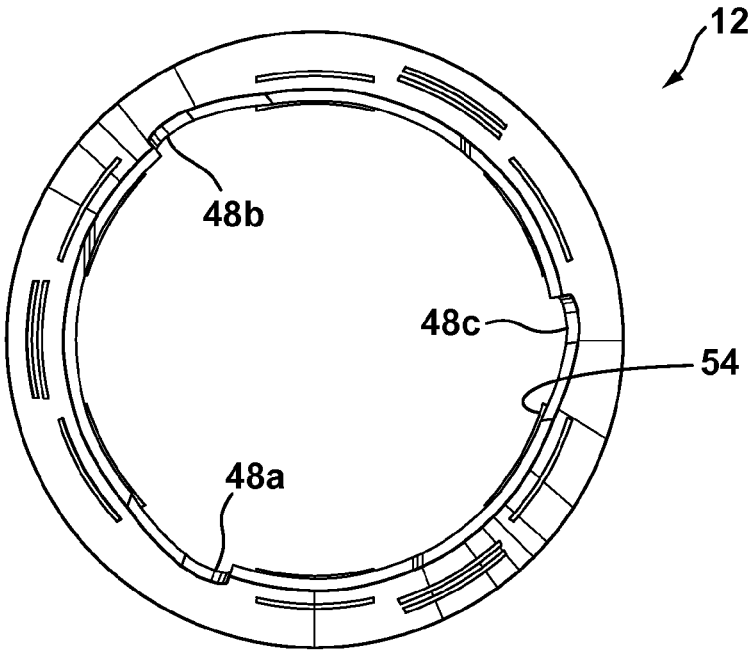
FIG. 8C is a bottom view of the example of a fuel efficiency enhancement device shown in FIG. 8A.
Figure 8D:
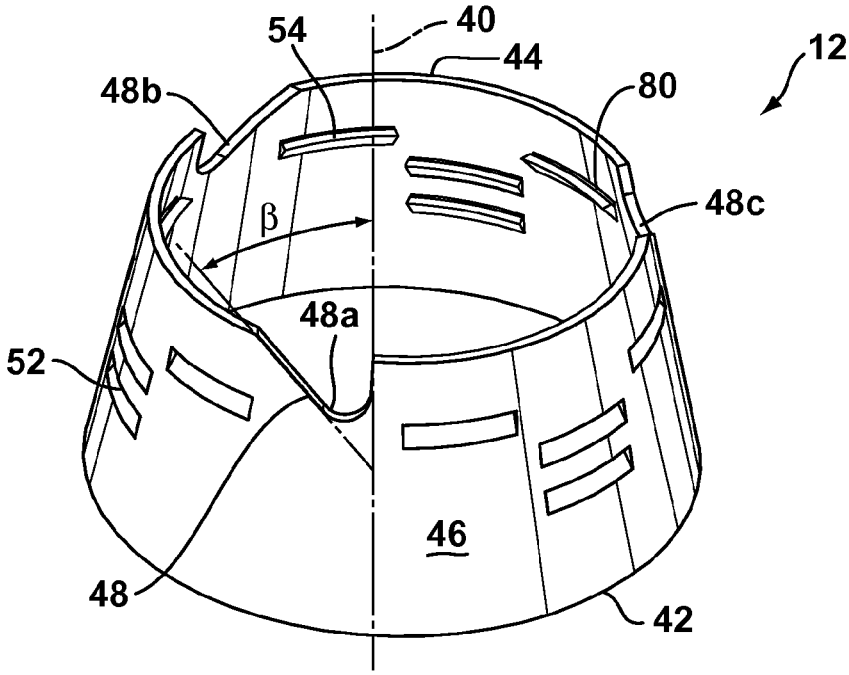
FIG. 8D is a bottom perspective view of the example of a fuel efficiency enhancement device shown in FIG. 8A.

FIG. 7 shows installation of a conditioner 12 with tabs 52*a-c*, notches 48*a-c*, and varying taper zone portions 56, 58, 60 installed in a pipe or duct 70 representing an air intake duct for a spark ignition engine. For this installation, the conditioner 12 is positioned immediately downstream of the butterfly throttle valve/plate 72 and upstream from the fuel-air mixer (i.e., fuel injector, etc.).

A preferred angular orientation of the conditioner 12 with respect to the butterfly throttle valve/plate 72 is illustrated in FIG. 7. One of the notches, 48*b*, is aligned with the top of the throttle valve/plate 72, which rotates away from the conditioner 12 when the butterfly throttle valve/plate 72 is actuated from the closed position to the open position. As a result, the other two notches, 48*b* and 48*c*, are positioned such that the contiguous portion of the conditioner 12 between notches 48*a* and 48*c* is aligned with the bottom of the throttle valve/plate 72, which rotates toward the conditioner 12 when the butterfly throttle valve/plate 72 is actuated from the closed position to the open position.

FIGS. 8A through 8D show another alternative embodiment of the air flow conditioner 12. As can be seen, this embodiment of the conditioner 12 is again generally conical-shaped with a central axis 40. Similar to the other embodiments, the conditioner 12 of FIGS. 8A-8D includes an inlet 42, an outlet 44 with the circumference smaller than that of the inlet 42 and a wall 46 that interconnects the inlet and outlet. The taper angle $\alpha$ formed between a line parallel to the central axis 40 and the exterior surface of wall 46 is again preferably in the range of about 10 degrees to about 20 degrees.

Figure 19:
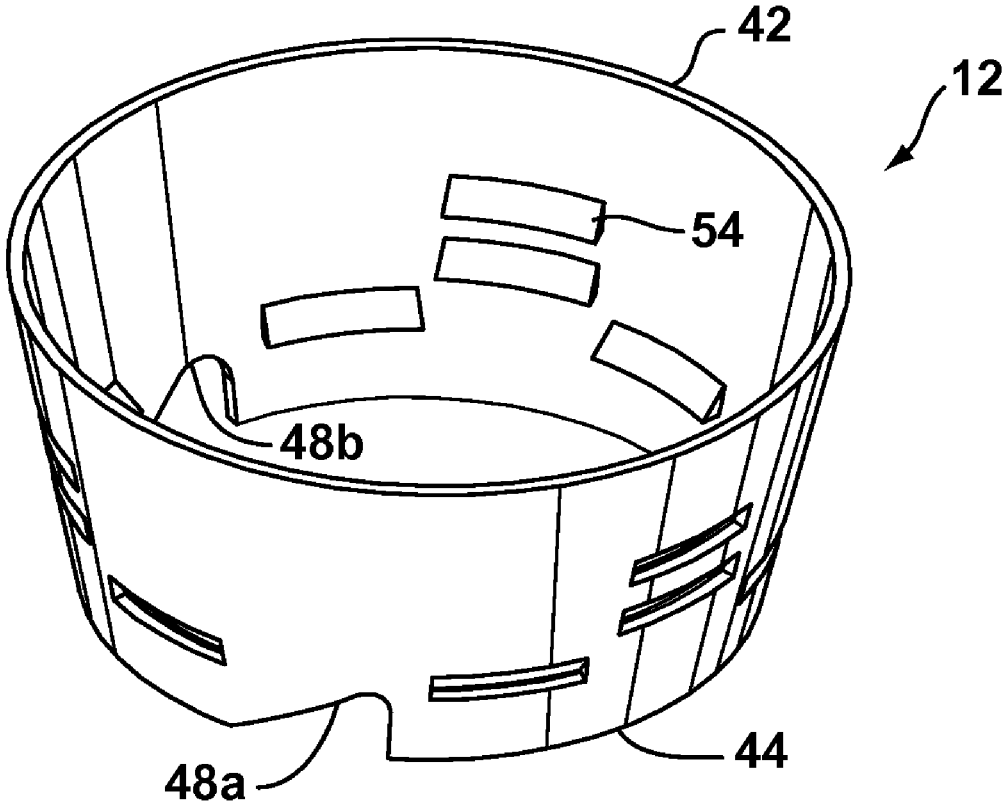
FIG. 19 is a perspective view of the fuel efficiency enhancement device shown in FIG. 8A showing variations in the configuration of the features of the same.

The conditioner 12 of FIGS. 8A-8D includes a plurality of circumferentially spaced notches 48*a-c* formed in the wall 46 adjacent the outlet 44. While three such notches are shown, there can be more or less number of notches. Notches 48*a*-48*c* can be symmetrically spaced. As best seen from FIG. 8D each of the notches 48*a*-48*c* has a curved closed end and a notch opening at the edge of the outlet 44, and extend along the wall 46 toward the inlet 42 at a slant angle with respect to the central axis 40. The slant angle $\beta$ of the notches may be the same for all notches 48*a*-48*c* or can be different for each of the notches Also, as shown in FIG. 19, one or more of the plurality of notches may be slanted in an orientation different (or even opposite) from that of other ones of the plurality of notches.

The conditioner 12 of FIGS. 8A-8D also includes a plurality of tabs 52 formed in the wall 46 intermediate the inlet 42 and the outlet 44. In the example shown, the tabs 52 are arranged into several clusters of tabs, where three such clusters shown in FIGS. 8A-8D. Also, in the example shown, each cluster consists of four tabs 52 in a formation of two vertically aligned tabs and two horizontally aligned tabs. The clusters of tabs 52 can be symmetrically spaced, and can be in alternating location with respect to the notches 48*a*-48*c*, i.e., each cluster of tabs 52 can be placed at the gap between two notches. As best seen from FIG. 8C, each of the tabs 52 includes a ramp 54 extending from the wall 46 into the conditioner 12. The punch hole 80 remaining in the wall 46 is an artifact created during the fabrication of the tab 52, and in a different embodiment can be filled to seal the opening or, in the alternative, the tab could be built up on the wall 46 without the punch hole 80 being created.

An analytical tool available to simulate the effects of the various deformations, i.e., the tabs 52 and notches 48 on the aforementioned flow characteristics, e.g., the velocity, direction and pressure, is what is known in the art as the computational fluid dynamics (CFD), for which a computer software, for example, the COSMO FloWorks™ available from Solid Solution Management Limited based in the United Kingdom, could be used to analytically simulate fluid dynamics for a given conditions, and the geometry of, the flow path, which can be modeled using computer aided design (CAD) software, for example, the SolidWorks™ CAD program available from the same UK company.

Figure 9:
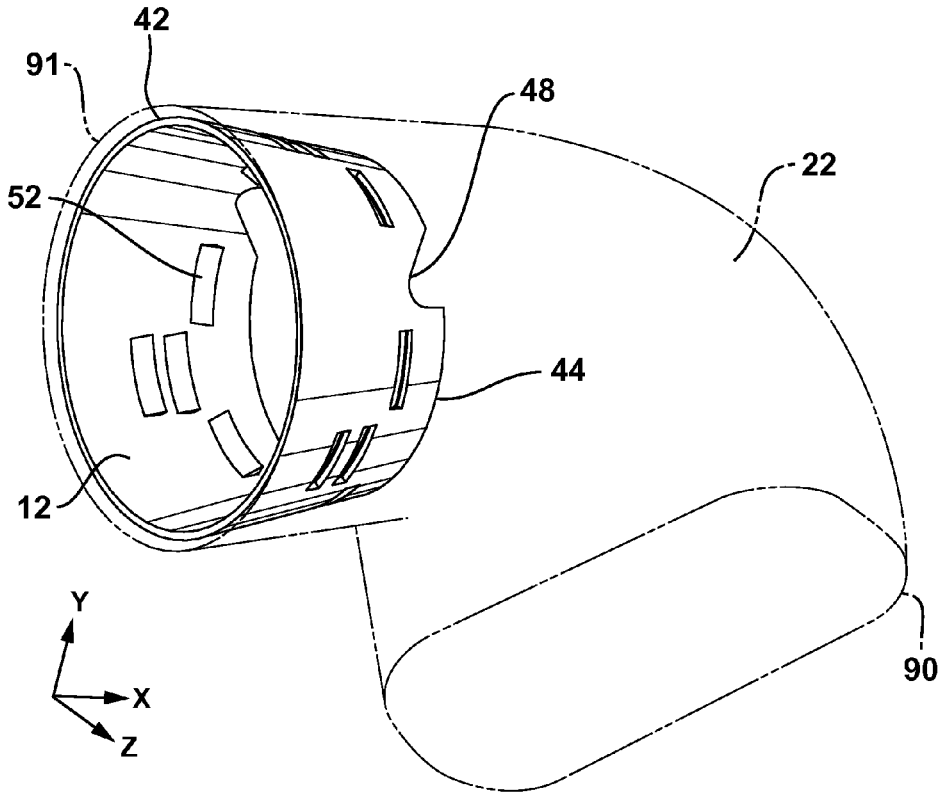
FIG. 9 is perspective view of the example of a fuel efficiency enhancement device shown in FIG. 8A installed in a snorkel of a diesel engine.

As an illustration of analytical studies of the effects of the conditioner 12 on the flow of gas and/or air in an internal combustion engine, a simulation of each embodiment of conditioners shown in FIG. 2 and FIGS. 8A-8D installed at the inlet of snorkel 22 (FIG. 1) of a turbocharged diesel engine will be discussed. Shown in FIG. 9 is a model of the conditioner 12 of FIGS. 8A-8D installed in the snorkel, created using a CAD program. A similar CAD modeling of the conditioner 12 of FIG. 2 can also be made using the same geometry of the snorkel 22 shown in FIG. 6 in both cases. The snorkel can be modeled after a real life snorkel of an existing diesel engine, for example Mercedes MBE4000 engine.

Once the flow path geometry is modeled, several boundary conditions can be specified, including the pressure at the inlet 91 of the snorkel 22. For this study, to simulate the air supply from the turbocharger, a constant pressure of 30 psi (absolute) was specified as the inlet pressure. The boundary condition that may also be specified is the pressure at the outlet 90 of the snorkel 22, which for this analysis, was set as a volumetric flow rate of 1000 cubic feet per minute.

Figure 2:
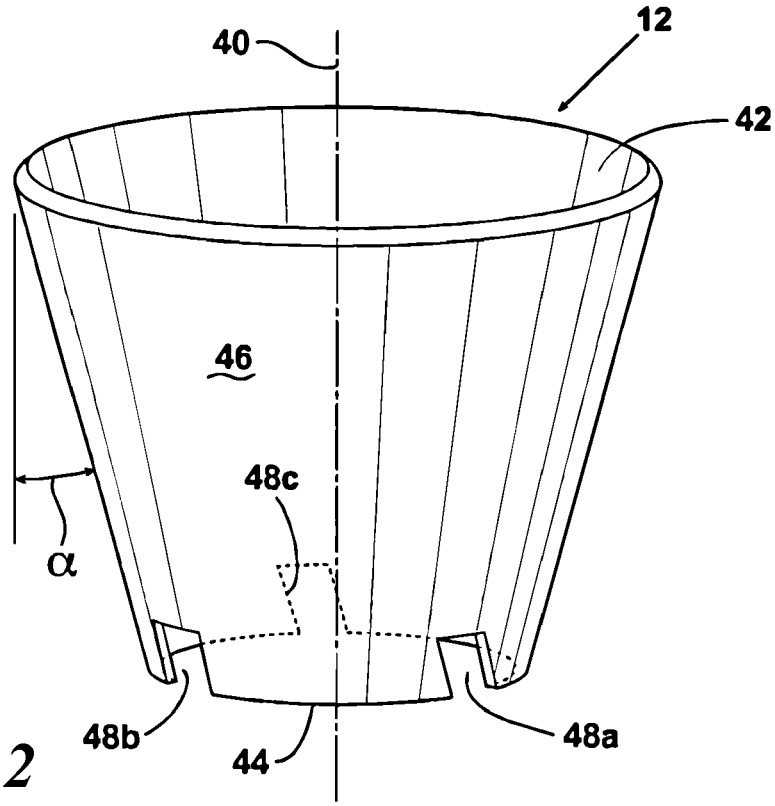
FIG. 2 is a front elevational view of an example of a fuel efficiency enhancement device.
Figure 10A:
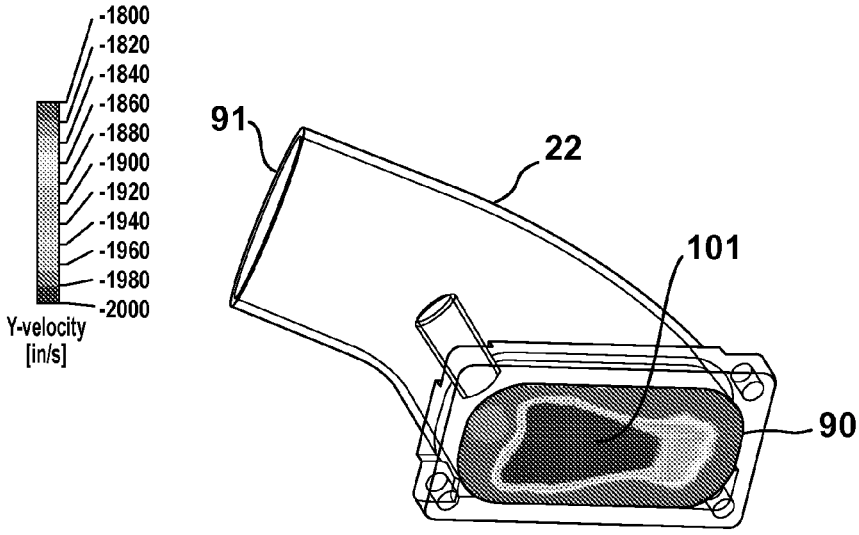
FIG. 10A illustrates a flow velocity distribution characteristics of the flow of gas at the air inlet of the diesel engine when no fuel efficiency enhancement device is placed therein.
Figure 10B:
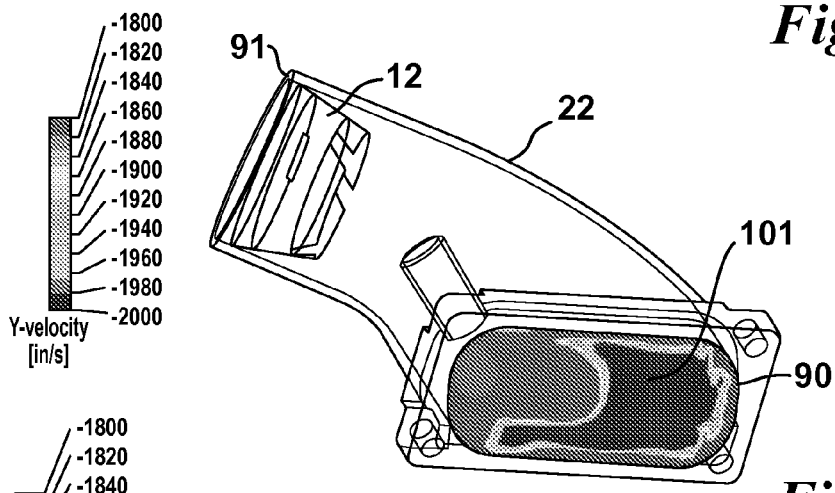
FIG. 10B illustrates a flow velocity distribution characteristics of the flow of gas at the air inlet of the diesel engine when a fuel efficiency enhancement device of FIG. 2 is placed therein.
Figure 10C:
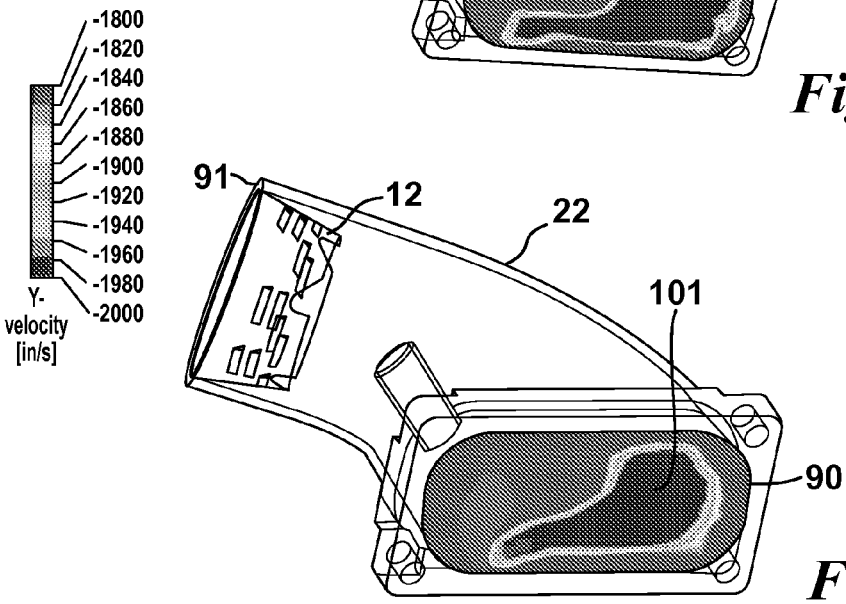
FIG. 10C illustrates a flow velocity distribution characteristics of the flow of gas at the air inlet of the diesel engine when a fuel efficiency enhancement device of FIG. 8A is placed therein.
Figure 11A:
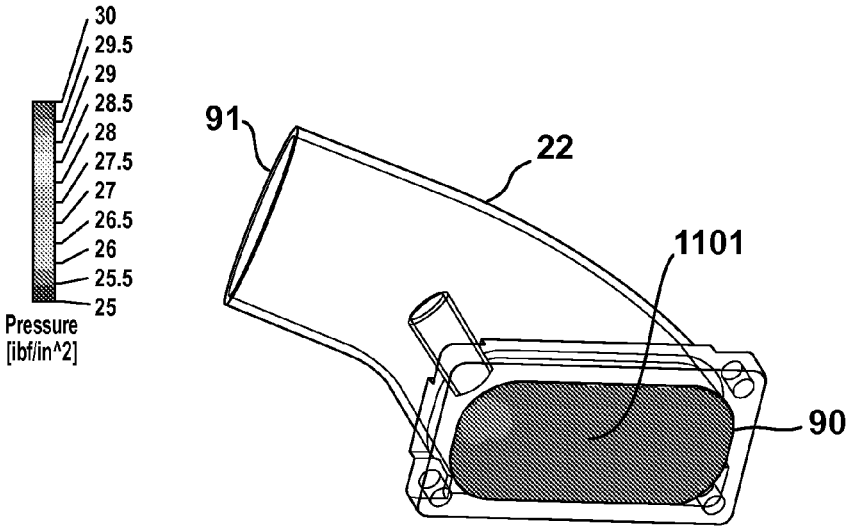
FIG. 11A illustrates a pressure distribution characteristics of the flow of gas at the air inlet of the diesel engine when no fuel efficiency enhancement device is placed therein.
Figure 11B:
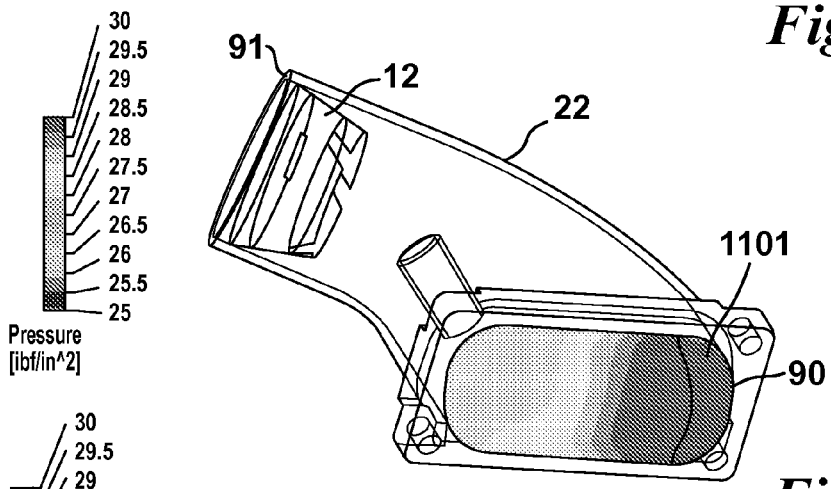
FIG. 11B illustrates a pressure distribution characteristics of the flow of gas at the air inlet of the diesel engine when a fuel efficiency enhancement device of FIG. 2 is placed therein.
Figure 11C:
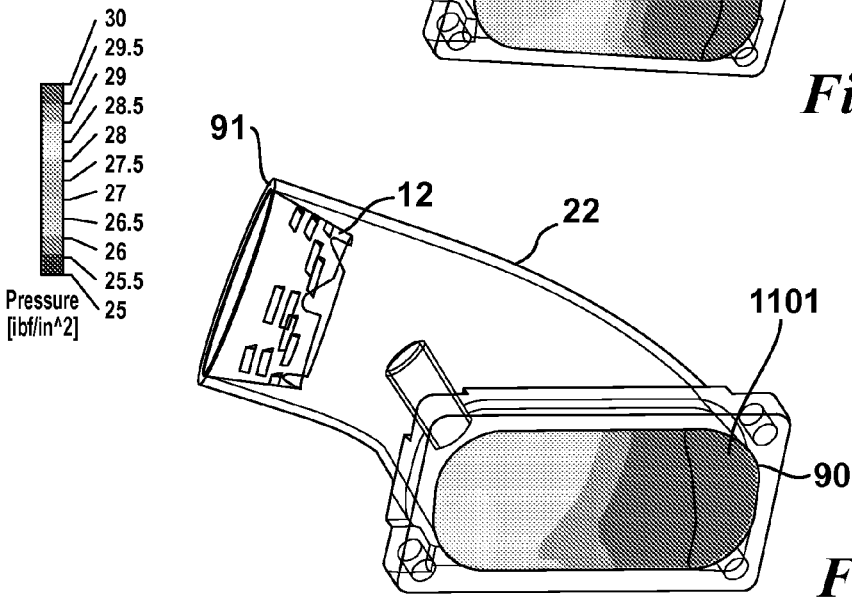
FIG. 11C illustrates a pressure distribution characteristics of the flow of gas at the air inlet of the diesel engine when a fuel efficiency enhancement device of FIG. 8A is placed therein.
Figure 12A:
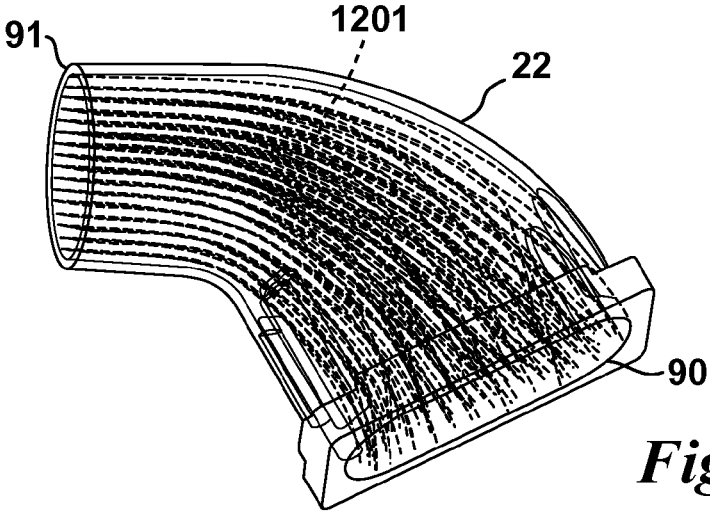
FIG. 12A illustrates a pressure distribution characteristics of the flow of gas within the diesel engine snorkel when no fuel efficiency enhancement device is placed therein.
Figure 12B:
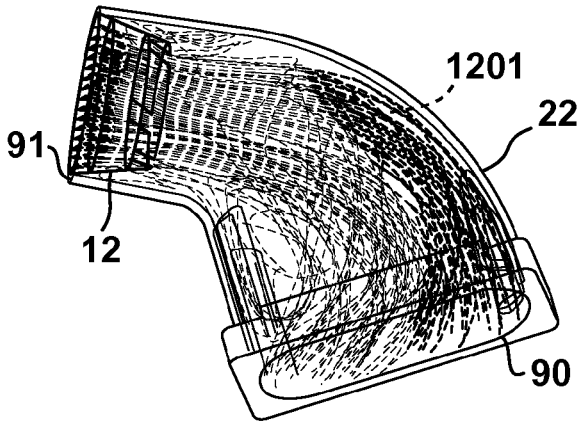
FIG. 12B illustrates a pressure distribution characteristics of the flow of gas within the diesel engine snorkel when a fuel efficiency enhancement device of FIG. 2 is placed therein.
Figure 12C:
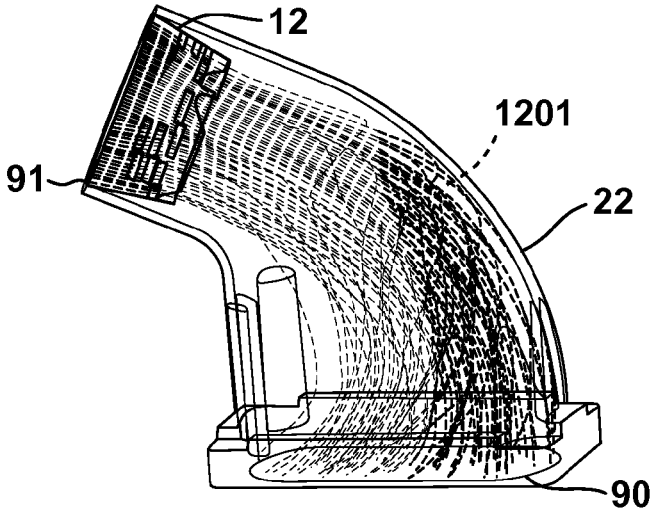
FIG. 12C illustrates a pressure distribution characteristics of the flow of gas within the diesel engine snorkel when a fuel efficiency enhancement device of FIG. 8A is placed therein.

As a reference point for the study, the snorkel 22 without a conditioner 12 is simulated first. FIGS. 10A, 11A and 12A show the result of the simulation. These results are then used as a reference to be compared with simulations of the air flow in the snorkel 22 with conditioners 12 installed to observe the effects from the conditioners 12 on the airflow within the snorkel 22, and also at the outlet 90 (or the inlet of the intake manifold 24 (FIG. 1)). FIGS. 10B, 11B and 12B show the airflow characteristics when the conditioner 12 of FIG. 2 is installed in the snorkel 22. FIGS. 10C, 11C and 12C show the result of the simulation with the conditioner 12 of FIGS. 8A-8D installed in the snorkel 22.

FIGS. 10A, 10B and 10C each show a simulated measurement of the airflow velocity at the outlet 90, airflow of different velocity being represented by different shading or color. The darker region 101 represents higher velocity at the outlet 90 of the snorkel 22. In comparing the airflow velocity distribution at the outlet 90 in each of FIGS. 10A, 10B and 10C, it can be seen, for example, the higher velocity region 101 has increased in size in each of FIGS. 10B and 10C as compared to that of FIG. 10A. The average velocity over the entire outlet 90 can also be seen as having noticeably increased. in each of FIGS. 10 B and 10C. The result of this analytical study shows that each of the conditioners 12 significantly improves overall airflow velocity as the air flows into the intake manifold 24.

FIGS. 11A, 11B and 11C each show a simulated measurement of the pressure at the outlet 90, different pressure level being represented by different shading. The darker region 1101 represents a higher pressure level at the outlet 90 of the snorkel 22. In comparing the pressure distribution at the outlet 90 in each of FIGS. 11A, 11B and 11C, it can be seen, for example, consistent with the observation of the effects on the airflow velocity as discussed above, the higher pressure region 1101 has dramatically decreased in size in each of FIGS. 11B and 11C as compared to that of FIG. 11A. The average pressure over the entire outlet 90 can also be seen as having noticeably decreased. in each of FIGS. 11B and 11C. The result of this analytical study shows that each of the conditioners 12 significantly lowers overall average pressure the airflow is subject to as the airflow enters the intake manifold 24.

FIGS. 12A, 12B and 12C each show a simulated flow path of mass-less air particles within the snorkel 22, the path of airflow being graphically represented by flow lines 1201. The CFD software is also capable of representing different levels flow velocity or pressure of the airflow by different thicknesses of the flow lines. The darker region 1201 represents a higher pressure level. As can be seen from FIG. 12A, without a conditioner 12 installed, the airflow in the snorkel 22 takes relatively undisturbed flow lines 1201. The flow lines 1201 in this case also are relatively evenly distributed within the entire volume of the snorkel 22. In comparison, FIG. 12B shows the flow lines 1201 of the airflow in the snorkel 22 with the conditioner of FIG. 2 installed therein, which take drastically more turbulent paths, shown by the flow lines having rotational travel paths. Similarly, FIG. 12C shows the flow lines 1201 of the airflow in the snorkel 22 with the conditioner of FIGS. 8A-8D installed therein, which also shows flow lines having rotational travel paths. The result of this analytical study shows that each of the conditioners 12 imparts significant turbulence in the airflow, which is carried by the airflow as the air enters the intake manifold 24.

Figure 13:
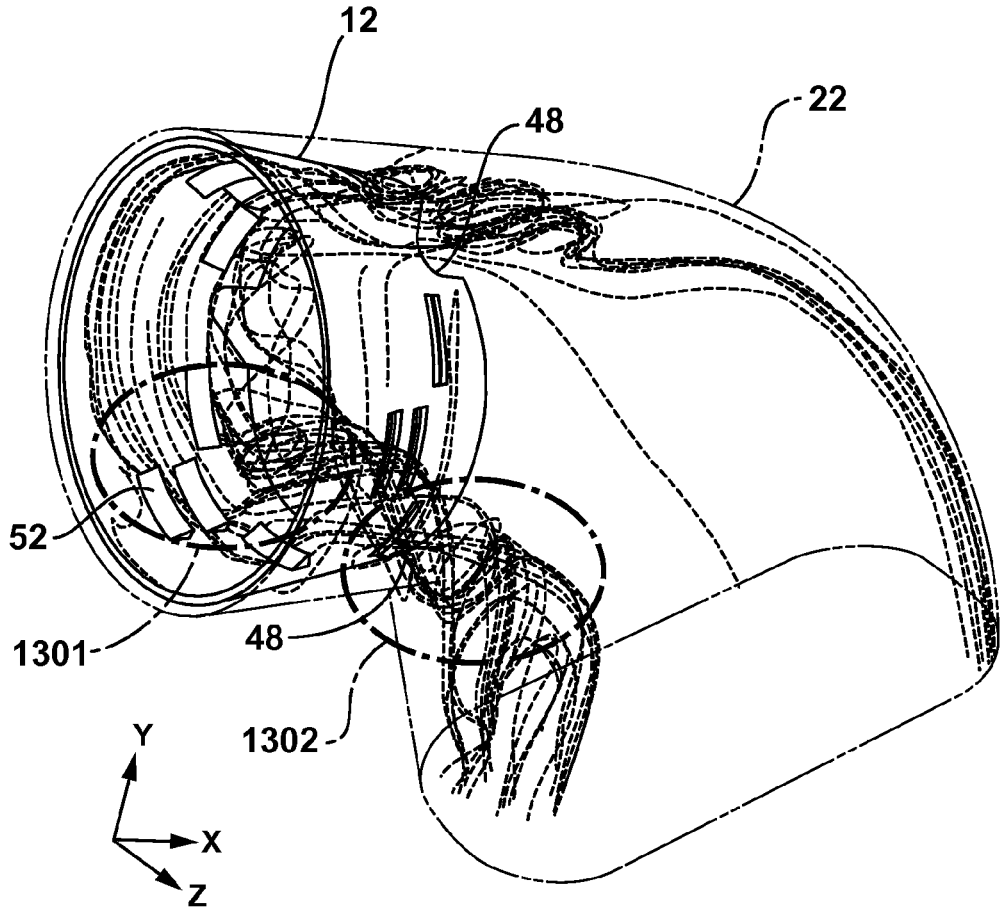
FIG. 13 illustrates air flow path characteristics of portions of air flowing within the diesel engine snorkel with a fuel efficiency enhancement device of FIG. 8A installed therein, and illustrates the different types of turbulence created by the structural features of the fuel efficiency enhancement device of FIG. 8A placed in the air flow path.
Figure 23:
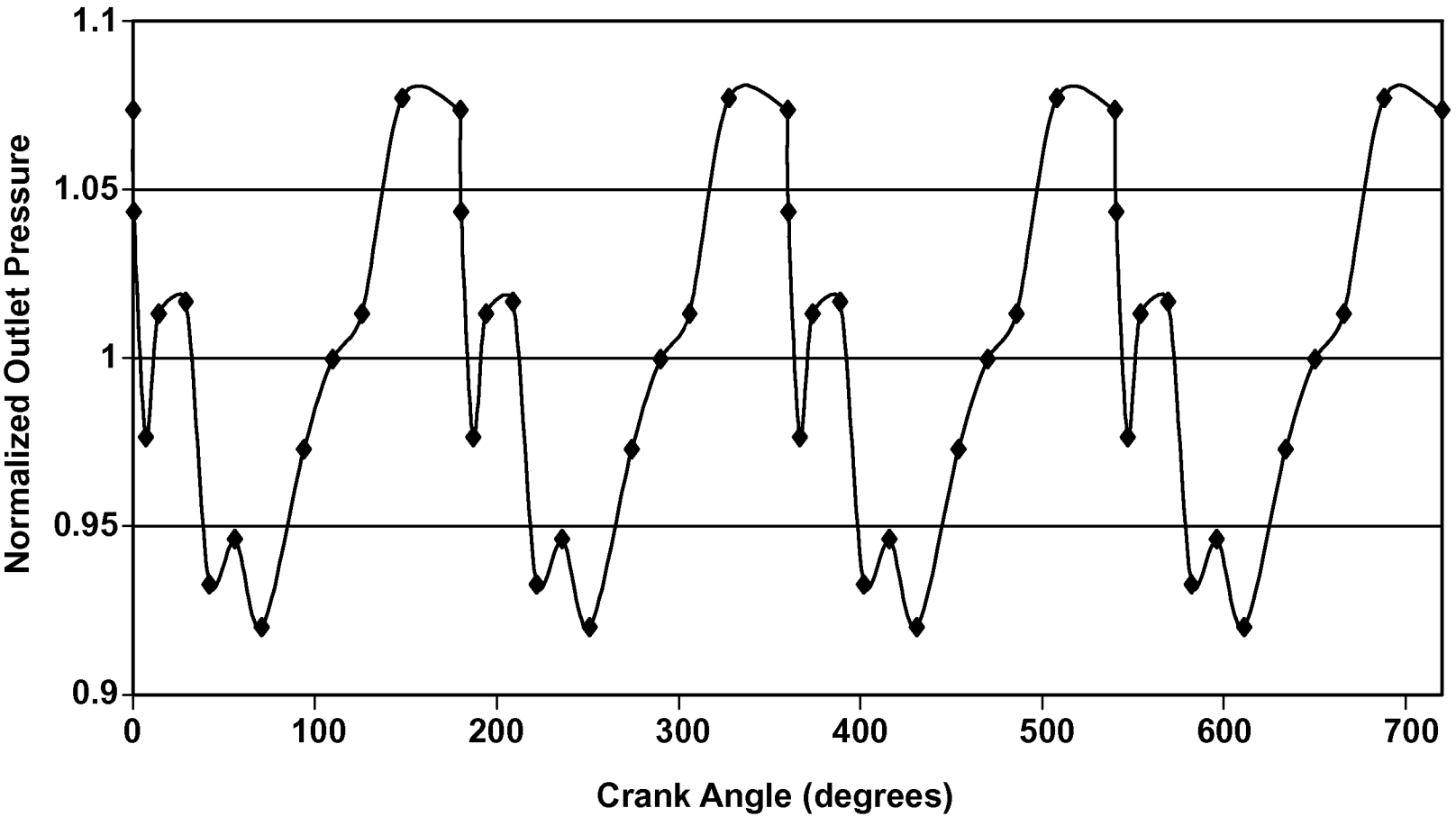
FIG. 23 is a plot showing the pressure profile at the air inlet of the diesel engine in operation.

FIG. 13 shows a snapshot of an animation of the air flow in the model of the conditioner 12 of FIGS. 8A-8D in the snorkel 12. The animation may be created using CFD animation software, for example, the Fluent™ software available from Fluent, Inc., headquartered in Canonsburg, Pa., U.S.A. A similar animation can also be obtained for the case of the conditioner 12 of FIG. 2 installed in the snorkel 22. A constant pressure of 30 psi (absolute) was again specified as the inlet pressure boundary condition. The boundary condition at the outlet 90 of the snorkel 22, for a more realistic study, was chosen to be dynamic accounting for the variations in pressure due the opening and closing of the intake valves and the motion of the piston that may exist in an actual engine in operation, and is specified as the profile shown in FIG. 23.

Referring to FIG. 13, there may be at least two different identifiable types of turbulence imparted by the conditioner 12. The first is a tumbling effect, which can be observed as being imparted or initiated at the tab 52. That is, the major component of the turbulence over the tabs 52 is a rotational force imparted on the airflow such the airflow rotates about an axis generally perpendicular to the central axis 40 of the conditioner 12. The tumble flow can be seen to have fully developed by the time the airflow reach the outlet 90 of the snorkel 22.

Another type of turbulence the conditioner 12 may impart as seen in FIG. 13 is the swirling of the airflow as the flow exits the notches 48. That is the rotational flow pattern of the airflow about an axis generally parallel to the central axis 40 of the conditioner 12.

A similar analytical study can be performed for the case of a spark ignition engine by modeling of the airflow system, for example, the air inlet structure illustrated in FIG. 7. The analytical study above described can be used to develop a design of a conditioner 12 into a newly designed engine or as a predictor of performance of a conditioner 12 of a particular design in an existing engine.

In addition or in lieu of the analytical study of simulated performance of a particular design of a conditioner 12, an empirical study can also provide a means to validate a design. For example, a conditioner 12 can be installed on actual vehicles of various types, and the fuel efficiency, engine performance and the emission level can be measured over time of operation of the vehicles. Several such studies have been conducted with various designs of conditioner 12 on many existing different types of vehicles, including small economy sized passenger cars, sport utility vehicles (SUVs) to a fleet of larger freight trucks, of both spark ignition type engines and compression ignition engines, and even a motorcycle.

The conditioner 12 can be fabricated as a die-cut metal, but could be made of high strength plastic material that is capable of withstanding the extremes of temperature and pressure that is possible in an internal combustion engine. The conditioner 12 can be provided as a separate insert device for installing into the throttle body of gasoline engines or in the snorkel region in diesel-powered engines of existing vehicles, or can be designed and built into a newly manufactured engine.

Figure 14:
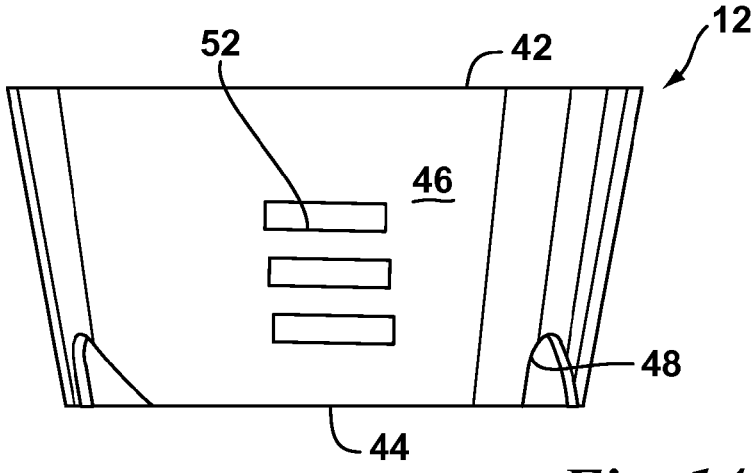
FIG. 14 is a front elevational view of another embodiment of the fuel efficiency enhancement device.
Figure 15:
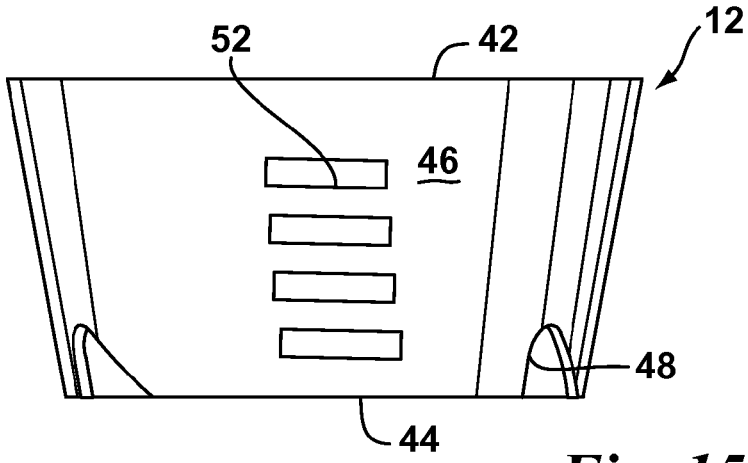
FIG. 15 is a front elevational view of yet another embodiment of the fuel efficiency enhancement device.
Figure 16:
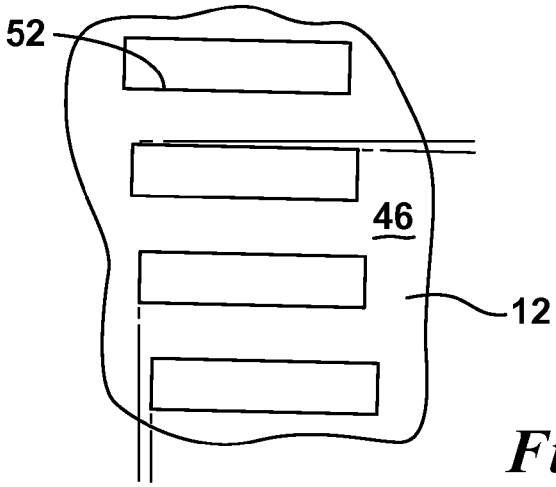
FIG. 16 is a close up view of the embodiment shown in FIG. 15 to illustrate details of some of the structural features.

Many variations of the tabs and notches structures are possible as well as the variation of the multiple taper angles $\alpha$ as described in connection with FIG. 5. For example, FIG. 14 shows an embodiment of conditioner 12 that has three vertically aligned tabs 52 that are proportionally larger in size relative to the sizes of the notches 48. FIG. 15 shows an embodiment where the tabs 52 are proportionally smaller in size relative to the notches 48. These variations will result in relatively different levels of the tumbling and swirling effect imparted in the airflow. As can be seen from FIG. 16, the tabs 52 can be in perfect vertical alignment with each other or can be staggered in vertical direction such that one or more tabs 52 may extend further in either horizontal direction along the wall 46 than other ones of the tabs 52. In addition, FIG. 16 also shows that each tab 52 can be horizontally parallel or could be slanted or not leveled horizontally, or can have varying width of the ramp 54 (not shown) across the length of the tab 52 such that the ramp 54 acts similar to a propeller or a fan blade.

Figure 17:
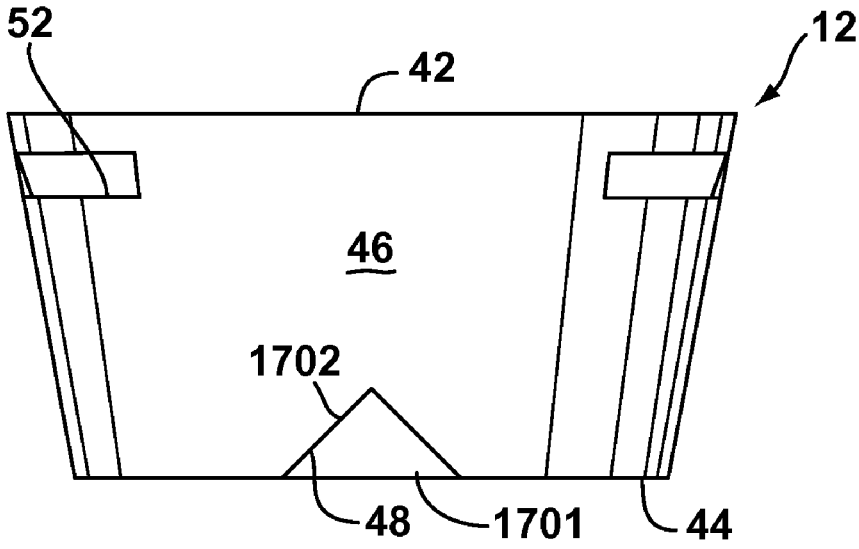
FIG. 17 is front elevational view of even yet another embodiment of the fuel efficiency enhancement device.
Figure 18:
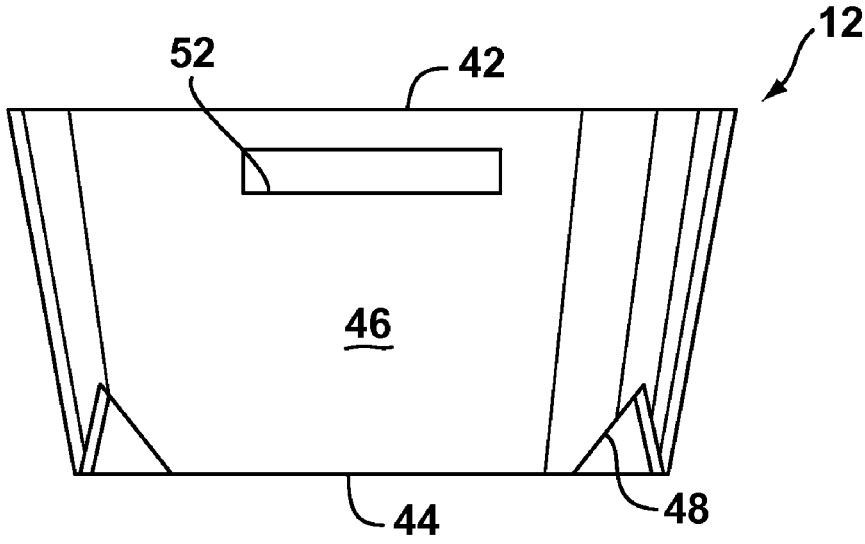
FIG. 18 is front elevational view of the fuel efficiency enhancement device shown in FIG. 17 at a different viewing orientation.

FIGS. 17 and 18 show another embodiment that includes only one tab 52 between each pair of notches 48, which is in generally in a triangular shape. As this embodiment illustrates the notch 48 of different designs can take any shape, but shares the general characteristic of having a notch opening 1701 at the outlet 44 and a closed end 1702 on the wall 46 upstream of the outlet 44, i.e., toward the inlet 42. Also, any number of the tabs 52 could be provided in any formations or clusters, but in all cases are provided on the wall 46 between the inlet 42 and the outlet 44, and includes a ramp 54 extending from the interior of the wall 46 into the volume of the conditioner 12 defined by the wall 46.

Figure 20A:
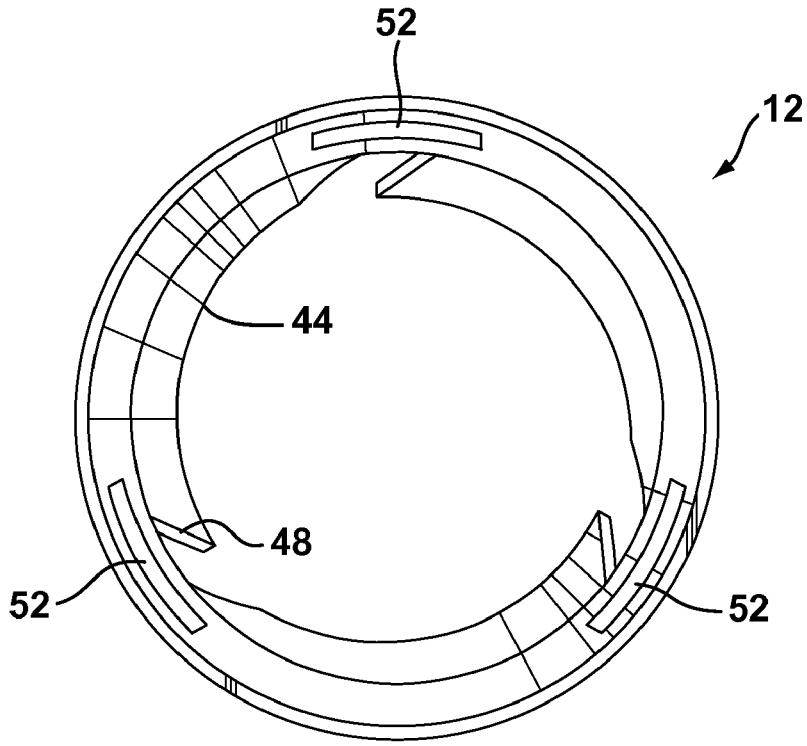
FIG. 20A is a top view of another embodiment of the fuel efficiency enhancement device.
Figure 20B:
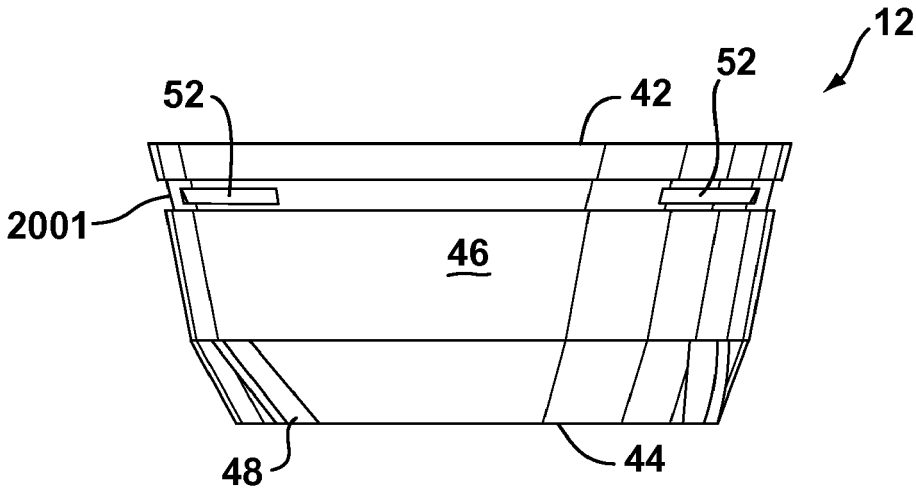
FIG. 20B is a side elevational view of the embodiment shown in FIG. 20A.
Figure 21:
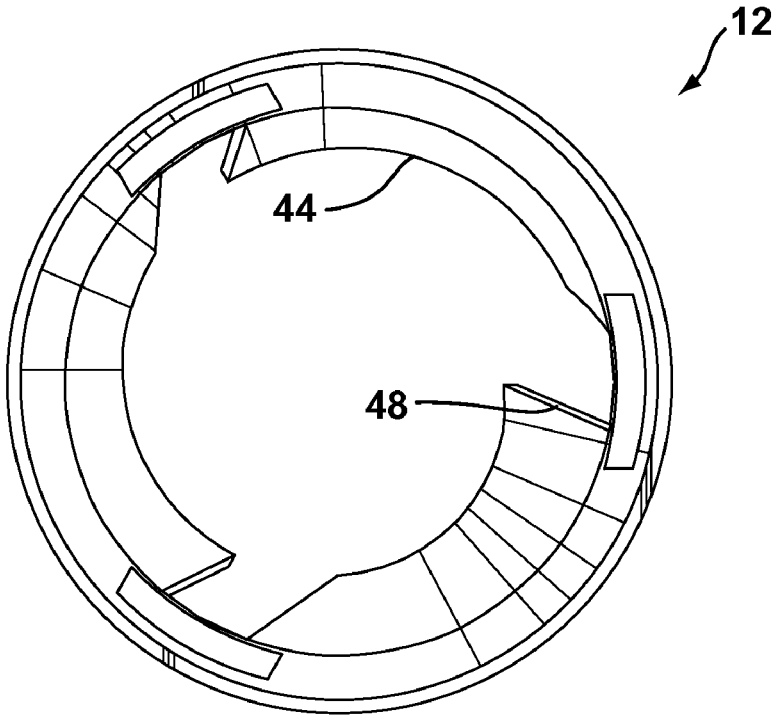
FIG. 21 is a top view of yet another embodiment of the fuel efficiency enhancement device.

FIG. 20A shows yet another embodiment with an additional feature of a helix formed at the bottom half portion near the outlet 44 of the conditioner 12 by continuously increasing the radius of the wall 46 moving circumferentially around from one notch 48 to the next adjacent notch 48. In this design, the helix is formed such that the gaps between each pair of adjacent notches 48 at the outlet 44 are made to be equal to each other. FIG. 20B shows the same embodiment, and illustrates another feature of a relief ring formed on the outer surface of the wall 46 near the inlet 42. The relief ring 2001 provides a region of thinner wall, which may be more easily punched through to form the tabs 52. FIG. 21 shows another embodiment similar to the one shown in FIG. 20A, and also includes a helix formed at the bottom half portion near the outlet 44 of the conditioner 12 by continuously increasing the radius of the wall 46 moving circumferentially around from one notch 48 to the next adjacent notch 48. But, in this design, the helix is formed such that the gaps between each pair of adjacent notches 48 at the outlet 44 are made to be unequal to each other.

Figure 22:
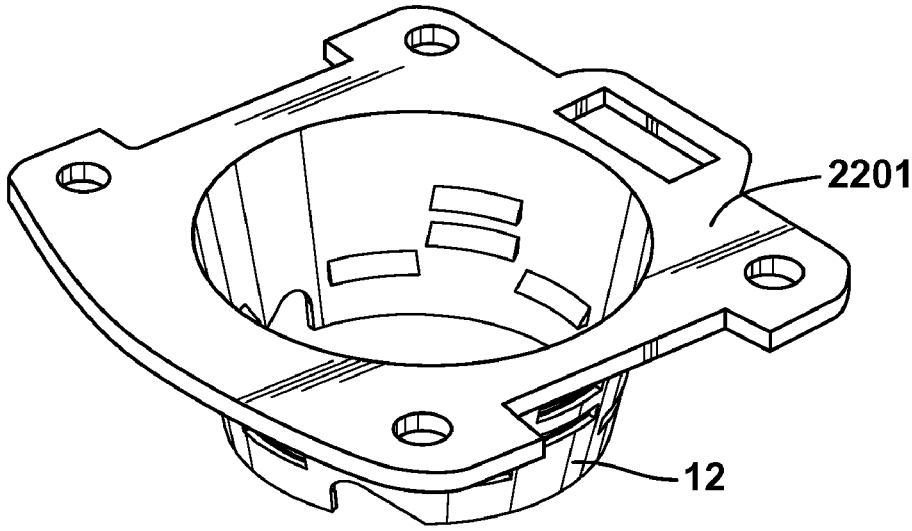
FIG. 22 is a top perspective view of a fuel efficiency enhancement device with a mounting flange.

As shown in FIG. 22, a mounting flange provided as either a separate structure to which the conditioner 12 can be mounted or as an integral part of the conditioner 12 to facilitate the mounting of the conditioner 12 in the IC engine.

Features from any of the various embodiments of conditioner 12 described above can be combined with features from other embodiments of conditioner 12 described above to create additional embodiments of conditioner 12.

As discussed, above, the conditioner 12 may be positioned at various points in an IC engine, including inside a duct or other passageway for intake air, a fuel-air mixture, or engine exhaust. The conditioner 12 may also be positioned in the intake and/or exhaust ports of the cylinder block 28 (FIG. 1) to enhance fuel efficiency.

The foregoing description details certain embodiments of the present invention and describes the best mode contemplated. It will be appreciated, however, that changes may be made in the details of construction and the configuration of components without departing from the spirit and scope of the disclosure. Therefore, the description provided herein is to be considered exemplary, rather than limiting, and the true scope of the invention is that defined by the following claims and the full range of equivalency to which each element thereof is entitled.

What is claimed:

1. A fuel efficiency enhancing structure for use in an internal combustion engine, comprising:

a generally conical-shaped flow path having an inlet through which at least one of air and fuel enters into said generally conical-shaped flow path and an outlet through which said at least one of air and fuel exits from said generally conical-shaped flow path, an inner volume of said generally conical-shaped flow path being defined by a wall interconnecting said inlet and said outlet, said outlet having an outlet circumference smaller than an inlet circumference of said inlet;

at least one tab disposed on said wall, said at least one tab protruding from said wall into said inner volume of said generally conical shaped flow path; and at least one notch formed on said wall, said at least one notch having an opening at said outlet of said generally conical-shaped flow path and a closed end defined by said wall at a location along said wall between said inlet and said outlet.

2. The fuel efficiency enhancing structure of claim 1, wherein:

said at least one notch comprises a plurality of notches circumferentially spaced with respect to each other; and wherein said at least one tab comprises a plurality of tabs circumferentially spaced with respect to each other.

3. The fuel efficiency enhancing structure of claim 2, wherein:

said plurality of notches are symmetrically spaced; and wherein said plurality of tabs are arranged into a plurality of sets of one or more tabs, each of said plurality of sets being disposed in an alternating manner with respect to said plurality notches such that each set of said plurality sets of one or more tabs being deposed between a pair of adjacent notches of said plurality of notches.

4. The fuel efficiency enhancing structure of claim 1, wherein:

wherein said closed end of said at least one notch having a curved shape.

5. The fuel efficiency enhancing structure of claim 1, wherein:

wherein said at least one notch having a triangular shape.

6. The fuel efficiency enhancing structure of claim 1, wherein:

at least one of said plurality of notches extending from said open end to said closed end along a direction that is not parallel to a central axis, said central axis being an axis extending through respective centers of said inlet and said outlet.

7. The fuel efficiency enhancing structure of claim 6, wherein:

said plurality of notches comprises a first one of said plurality of notches extending from said open end to said closed end along a first direction that is not parallel to said central axis, and a second one of said plurality of notches extending from said open end to said closed end along a second direction that is also not parallel to said central axis, said first direction being different from said second direction.

8. The fuel efficiency enhancing structure of claim 7, wherein:

said first direction being opposite from said second direction.

9. The fuel efficiency enhancing structure of claim 3, wherein:

each set of said plurality sets of one or more tabs comprises two or more tabs space apart in a first direction that extends from said inlet to said outlet, at least one of said two or more tabs extending in a second direction perpendicular to said first direction along said wall further than at least one other one of said two or more tabs.

10. The fuel efficiency enhancing structure of claim 1, wherein:

said at least one tab includes a ramp extending from said wall into said inner volume, said ramp including a ramp surface facing said inlet, said ramp surface having a width that varies from one end of said ramp to opposite end of said ramp.

11. The fuel efficiency enhancing structure of claim 10, wherein:

said ramp is not perpendicular to a central axis, said central axis being an axis extending through respective centers of said inlet and said outlet.

12. The fuel efficiency enhancing structure of claim 2, wherein:

said wall adjacent said outlet has an increasing radius from one of said plurality of notches to an adjacent one of said plurality of notches such that said wall adjacent said outlet forms a helical shape.

13. The fuel efficiency enhancing structure of claim 12, wherein:

said plurality of notches are equally spaced apart circumferentially.

14. The fuel efficiency enhancing structure of claim 12, wherein:

said plurality of notches are not equally spaced apart circumferentially.

15. The fuel efficiency enhancing structure of claim 1, wherein:

said at least one tab imparts a tumble to said at least one of air and fuel flowing within said inner volume of said generally conical-shaped flow path, said tumble being a rotational movement about a rotational axis substantially perpendicular to a central axis, said central axis being an axis extending through respective centers of said inlet and said outlet.

16. The fuel efficiency enhancing structure of claim 1, wherein:

said at least one notch imparts a swirl to said at least one of air and fuel exiting said inner volume of said generally conical-shaped flow path, said swirl being a rotational movement about a rotational axis substantially parallel to a central axis, said central axis being an axis extending through respective centers of said inlet and said outlet.

17. A fuel efficiency enhancing structure for use in an internal combustion engine, comprising:

a generally conical-shaped flow path having an inlet through which at least one of air and fuel enters into said generally conical-shaped flow path and an outlet through which said at least one of air and fuel exits from said generally conical-shaped flow path, an inner volume of said generally conical-shaped flow path being defined by a wall interconnecting said inlet and said outlet, said outlet having an outlet circumference smaller than an inlet circumference of said inlet;

at least one first deformation located along said wall of said generally conical-shaped flow path, said at least one first deformation interfering with a flow of said at least one of air and fuel to impart a tumbling movement to said flow, said tumbling movement being a rotational movement about a first rotational axis substantially perpendicular to a central axis, said central axis being an axis extending through respective centers of said inlet and said outlet; and at least one second deformation located along said wall of said generally conical-shaped flow path, said at least one second deformation imparting a swirling movement to said flow of said at least one of air and fuel, said swirling movement being a rotational movement about a second rotational axis substantially parallel to said central axis.

18. The fuel efficiency enhancing structure according to claim 17, wherein:

said at least one first deformation being located along said wall at a location upstream of said at least one second deformation with respect to said flow of said at least one of air and fuel that flows from said inlet to said outlet.

19. The fuel efficiency enhancing structure according to claim 17, wherein:

said at least one first deformation comprises one or more tabs disposed on said wall, each of said one or more tabs protruding from said wall into said inner volume of said generally conical shaped flow path.

20. The fuel efficiency enhancing structure according to claim 17, wherein:

said at least one second deformation comprises one or more notches formed on said wall, each of said one or more notches having an open end at said outlet of said generally conical-shaped flow path and a closed end defined by said wall at a location along said wall between said inlet and said outlet.

* * * * *